United States Patent [19]

Kataishi et al.

[11] Patent Number: 4,515,552

[45] Date of Patent: May 7, 1985

[54] RELEASE AND CARRY-OUT APPARATUS

[75] Inventors: Takao Kataishi; Iwazou Seo, both of Tokyo, Japan

[73] Assignee: Misawa Home Co., Ltd., Tokyo, Japan

[21] Appl. No.: 313,132

[22] Filed: Oct. 20, 1981

[30] Foreign Application Priority Data

Apr. 17, 1981 [JP] Japan ..... 56-57941

[51] Int. Cl.[3] ..... B28B 7/08

[52] U.S. Cl. ..... 425/436 RM; 425/447; 425/452; 425/454

[58] Field of Search ..... 425/436 RM, 447, 452, 425/454

[56] References Cited

U.S. PATENT DOCUMENTS 2,495,100 1/1950 Henderson ..... 425/454
3,704,979 12/1972 Thiessen ..... 425/454
4,181,485 1/1980 Schramm ..... 425/454

FOREIGN PATENT DOCUMENTS 504884 7/1920 France ..... 425/454
231644 4/1925 United Kingdom ..... 425/454

*Primary Examiner*—John A. Parrish
*Attorney, Agent, or Firm*—Flynn, Thiel, Boutell & Tanis

[57] ABSTRACT

A release and carry-out apparatus is disclosed for removing a mold from a molding such as a concrete panel, and carrying out the molding to a predetermined position. This release and carry-out apparatus comprises: a base frame; an erectable frame erectably supported by this base frame; and a carrier for receiving only the molding disposed on a mold bed firmly, which bed is secured to this erectable frame when the erectable frame is erect, and carrying the molding to the predetermined position.

9 Claims, 11 Drawing Figures

RELEASE AND CARRY-OUT APPARATUS

BACKGROUND OF THE INVENTION

1. Field of the Invention

The present invention relates to a release and carry-out apparatus for removing a mold or the like from a molding such as a light-weight concrete panel and carrying the molding to a predetermined position.

2. Description of the Prior Art

Heretofore, in removing a mold from a molding such as a concrete panel, after the curing of the concrete panel, the mold has been removed by hand work at a very low working efficiency. Furthermore, in transporting the molding, a fork lift and the like has been used and this work has been carried out also at a low operating efficiency due to the one-by-one carry-out method employed.

Furthermore, recently, needs have been expressed for lighter materials for residence construction and lowered costs of architectural structures, with the result that cellular concrete panels and the like have been used as panel materials. Even for these cellular concrete panels, release and carry-out means usable at a high efficiency have been demanded due to a necessity for shorter construction terms.

SUMMARY OF THE INVENTION

The present invention has as its object the provision of a release and carry-out apparatus capable of removing a mold and the like from a molding such as a concrete panel and carrying the molding to a predetermined position at a high efficiency.

According to the present invention, an erectable frame for erecting and laying down a mold bed between a mold bed carry-in position and a mold bed upright position is provided on a base frame and, a carrier is provided which has support arms capable of receiving the molding erected together with the mold by this erectable frame, so that the releasing in an erected state and the subsequent carrying-out of the molding can be carried out by the carrier, thereby achieving the abovedescribed object.

DETAILED DESCRIPTION OF THE PREFERRED EMBODIMENT

Figure 1:
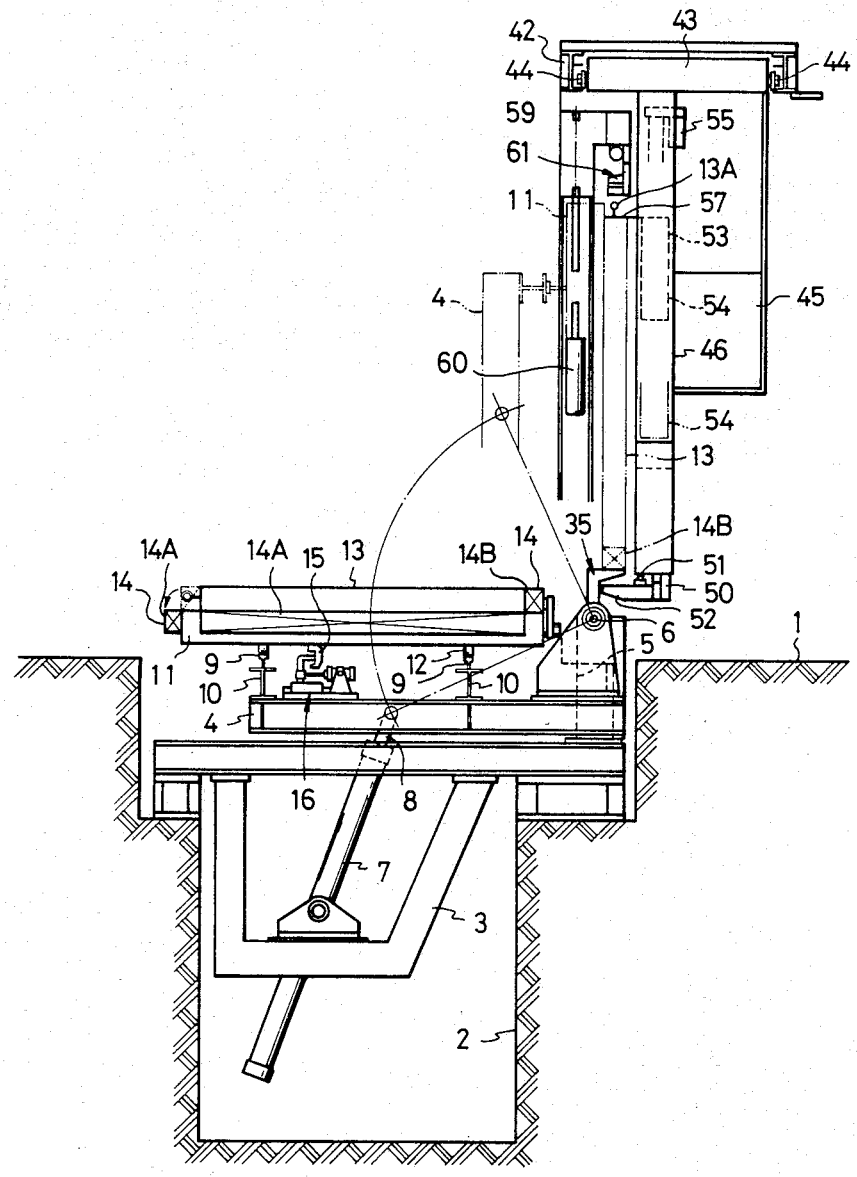
FIG. 1 is a side view showing the general arrangement of an embodiment of the release and carry-out apparatus according to the present invention.

In FIG. 1 showing the general arrangement, a floor 1 is provided with a recess 2, in which a base frame 3 is installed. Erectably supported at one side of this base frame 3 through a pair of bearings 5 and a shaft 6 (Refer to FIG. 2) are opposite ends of one side portion of an erectable frame 4, and rotatably secured to the intermediate portion of this erectable frame 4 is the forward end of a piston rod 8 of a cylinder 7 which is an erecting drive means. The intermediate portion of this cylinder 7 is rotatably mounted on a lower element of the base frame 3, and the erectable frame 4 is adapted to be erected, rotating about a shaft 6, from a carry-in position of a mold bed to be described hereinafter, i.e. a horizontal position, to a vertical (upright) position through the action of the rod 8 linearly movably through the action of the cylinder 7.

Laid on I-shape steel beams 10 on the erectable frame 4 are a pair of rails 9, on which are movably mounted wheels 12 of a mold bed 11, so that the carry-in of the mold bed 11 can be effected in a horizontal state. Arranged on the mold bed 11 is a mold 14 for defining the periphery of a concrete panel 13 made of a cellular concrete or the like. This mold 14 is formed of four columnar frame members arranged in the front and rear and on the right and left in a direction perpendicularly intersecting the paper surface in FIG. 1. The columnar members identified by reference number 14A, which are arranged in the front and rear and to the left in FIG. 1, are pivotably supported at respective side edges by the mold bed 11. When the mold bed 11 is carried onto the erectable frame 4, the members 14A are pivoted away from the side surfaces of the concrete panel 13 and are laid down alongside the mold bed 11. The remaining columnar member 14B arranged to the right in the drawing merely rests on the mold bed 11, when the mold bed 11 is carried onto the erectable frame 4, member 14B remains positioned on the mold bed 11. Furthermore, provided on the undersurface of the mold bed 11 are a pair of engageable members 15 arranged in the front and rear in FIG. 1 (refer to FIG. 4), which are provided at positions adjacent the left rail 9. Each member 15 is formed at the lower portion thereof with an engageable recess 15A which is U-shaped in cross section and opens toward the left rail 9.

Figure 2:
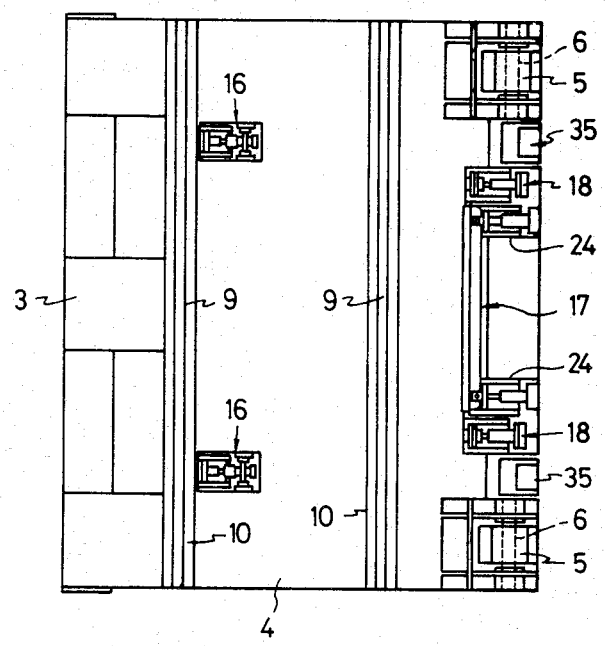
FIG. 2 is a plan view of the erectable frame.
Figure 3:
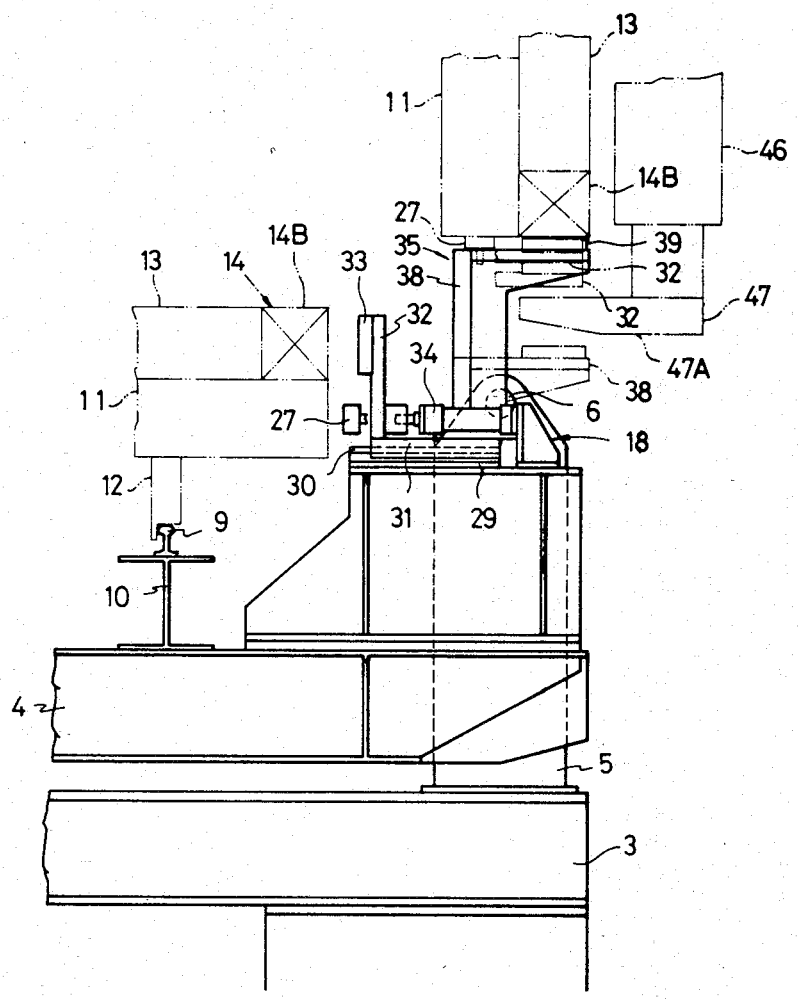
FIG. 3 is an enlarged side view of the molding supporting mechanisms thereof.
Figure 4:
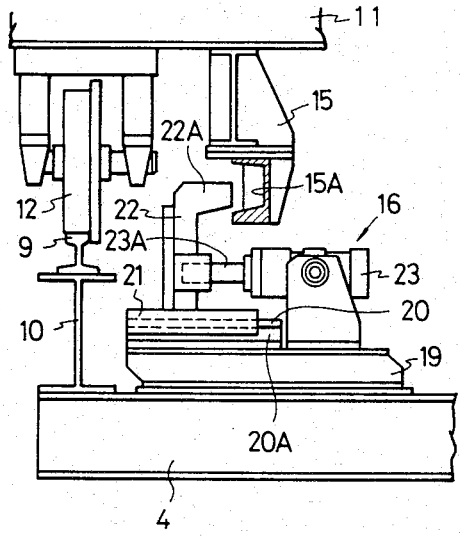
FIG. 4 is an enlarged side view showing the clamp mechanism used in this embodiment.
Figure 5:
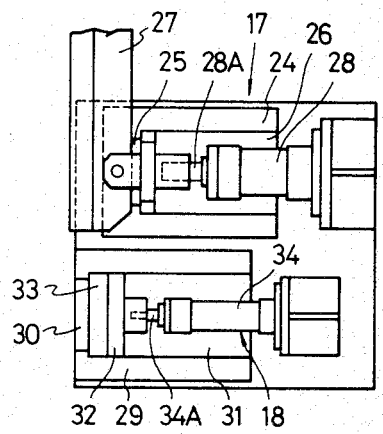
FIG. 5 is enlarged plan view partially showing the mold bed urging mechanism and the molding supporting mechanisms used in this embodiment.
Figure 6:
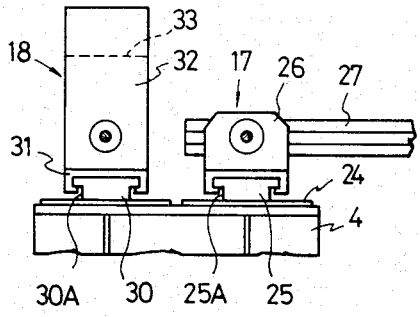
FIG. 6 is a simplified rear view thereof.

A pair of clamp mechanisms 16 engageable with the engageable members 15 formed on the undersurface of the mold bed 11 are provided on the erectable frame 4 (refer to FIGS. 2 and 4), a mold bed urging mechanism 17 is disposed at the central portion to the right in FIG. 2, and further, molding supporting mechanisms 18 are provided at the upper and lower positions adjacent the urging mechanism 17 in FIG. 2 (refer to FIGS. 5 and 6).

As shown in FIG. 4, each of the clamp mechanisms 16 comprises: a base 19 fixed onto the erectable frame 4; a guide rail 20 fixed onto the base 19 and formed at opposite sides thereof with guide grooves 20A; a slidable member 21 coupled to the guide rail 20 and slidably along the guide rail 20; a projected member 22 erected on the slidable member 21 and having an engaging projection 22A engageable with the engageable recess 15A of the engageable member 15; and a cylinder 23 rotatably supported on the base 19 by trunnions, the forward end of a piston rod 23A of which is connected to the projected member 22, so that the action of the cylinder 23 can engage the engaging projection 22A with the engageable recess 15A of the engageable member 15 fixed to the mold bed 11 or disengage the former from the latter.

As shown FIGS. 2, 5 and 6, the mold bed urging mechanism 17 comprises: a pair of bases 24 provided on the erectable frame 4 spaced apart a predetermined distance from each other; guide rails 25 fixed onto these bases 24, respectively, and formed at opposite sides thereof with guide grooves 25A; slidable members 26 coupled to the guide rails 25 and slidable along the guide rails 25; and urging member 27 secured across these slidable members 26; and cylinders 28 disposed on the bases 24, respectively, and the forward ends of piston rods 28A of which are connected to the respective slidable members 26, whereby the actions of these cylinders 28 cause the clamping member 27 to abut against the side surface of the mold bed 11 to urge the latter, so that this urging force can positively support the mold bed 11 in cooperation with the engaging force of the clamp mechanisms 16. Here, the mold bed urging mechanism 17, the clamp mechanisms 16 and the engageable members 15 constitute a mold bed securing mechanism.

As shown in FIGS. 2, 3, 5 and 6, the molding supporting mechanisms 18 comprise: bases 29 provided at opposite sides of the mold bed urging mechanism 17, respectively; guide rails 30 fixed onto these bases 29, respectively, and formed at opposite sides thereof with guide grooves 30A, respectively; slidable members 31 coupled to the guide rails 30, respectively, and slidable along the guide raisl 30; brackets 32 erected on these slidable members 31, respectively; abutting pads 33 projectedly provided on the upper portions of these support brackets 32 and not abutting against the mold bed 11, but rather abutting against only the columnar member 14B of the mold 14; and cylinders 34 fixed onto the bases 29, respectively, the forward ends of piston rods 34A of which are connected to the respective support brackets 32, whereby the actions of the cylinders 34 cause the abutting pads 33 to abut against the columnar member 14B, so that the panel 13 can be supported by way of this columnar member 14B when the erectable frame 4 is erected to a vertical position.

Figure 7:
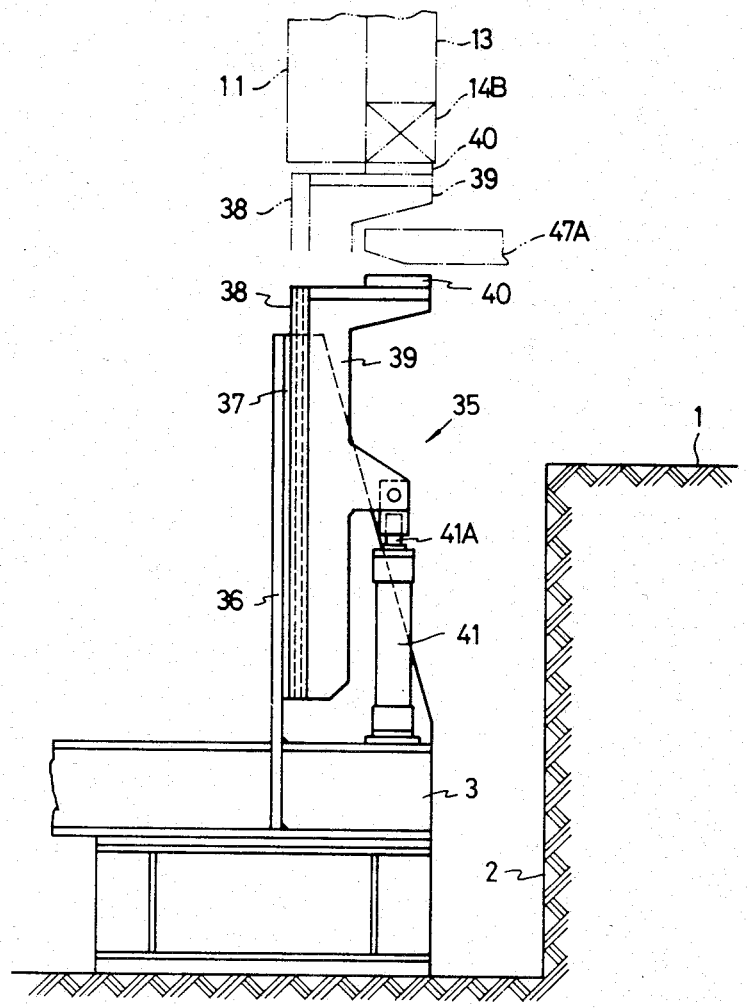
FIG. 7 is an enlarged side view showing the molding receiving mechanisms used in this embodiment.

Provided on the base frame 3 are molding receiving mechanisms 35 disposed at positions not interfering with the erectable frame 4 at opposite sides of the molding supporting mechanisms 18 (Refer to FIG. 2). Each of these molding receiving mechanisms 35, as enlargedly shown in FIG. 7, comprises: a bracket 36 erected on the base frame 3; a guide rail 37 fixed to the bracket 36 and being similar to that provided in the clamp mechanisms 16 and the like; a slidable member 38 slidably coupled to this guide rail 37; a receiving member 39 integrally fixed to this slidable member 38 and formed into a T shape as viewed from the right side in FIG. 7; an abutting pad 40 projectedly provided on this receiving member 39 and not abutting against the mold bed 11, but rather abutting against only the columnar member 14B; and a cylinder 41 fixed onto the base frame 3, the forward end of a piston rod 41A of which is connected to the receiving member 39, so that the panel 13 can be received, which panel is supported by the molding supporting mechanisms 18 of the erectable frame 4 in the erected state by the columnar member 14B.

As shown in FIG. 1, a gate-like panel carry-out carrier support frame 42 is provided at a position upwardly of the shaft 6 of the base frame 3, and a panel carry-out carrier 43 of the chain traction type, self-travelling type or the like is supported through wheels 44 by this support frame 42 in a manner to be movable in a direction perpendicularly intersecting the paper surface in FIG. 1. This carrier 43 comprises: a working table 45 as shown in FIGS. 1 and 8; a pair of guide supports 46 provided at the positions in a lateral direction in FIG. 8; slidable frame 49 slidably supported between these supports 46, respectively, vertically movable by means of cylinders 47 provided on the guide supports 46 through brackets 48; support arm guides 50 provided on the undersurface of this slidable frame 49; support arms 52 slidably supported by these support arm guides 50 and vertically movable by cylinders 51; and a lifting hook engaging mechanism 53 provided on the slidable frame 49 from the upper portion to the central portion thereof, so that the carrier 43 can be transferred by the driving force of a driving source, not shown, between a position for receiving the panel 13 and a predetermined position for the succeeding step of work.

Figure 8:
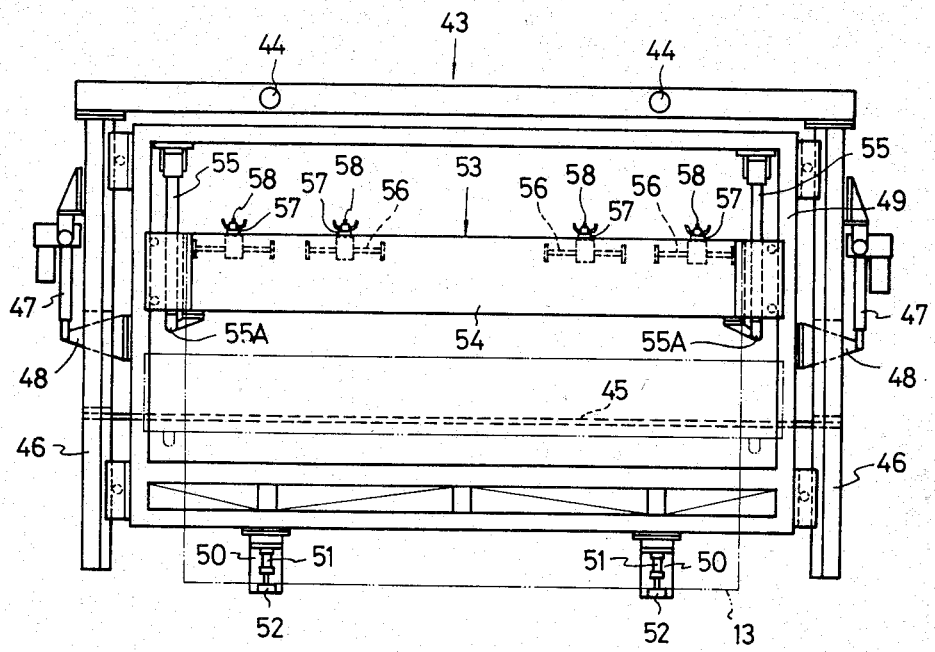
FIG. 8 is an enlarged front view showing the panel carry-out carrier used in this embodiment.
Figure 9:
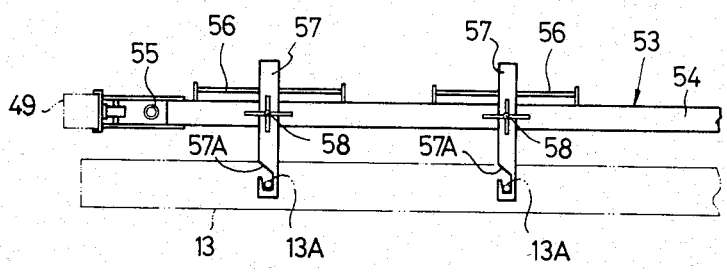
FIG. 9 is an enlarged plan view showing the essential portions of FIG. 8.

The lifting hook engaging mechanism 53 is a mechanism for supporting lifting hooks 13A and is enlargedly shown in FIGS. 8 and 9. In these drawings, the lifting hook engaging mechanism 53 comprises: a slidable plate 54 slidable in the slidable frame 49; cylinders 55 solidly secured at respective ends thereof to the undersurface of an upper frame portion of the slidable frame 49, and extended through opposite end portions of the slidable plate 54, whereby piston rods 55A provided at the forward end portions, which penetrate through the slidable plate 54, are connected to the slidable plate 54 so as to vertically move the slidable plate 54 along the slidable frame 49; a plurality of arms 57 provided in a manner to be slidable and fixable at given positions on guide bars 56 formed on the rear surface of the slidable plate 54 as shown in FIG. 8, and having grooves 57A engageable with the lifting hooks 13A; and fixing screws 58 for rotatably supporting these arms 57 on the upper surface of the slidable plate 54, respectively, and fixing the arms 57 at given positions. The height of the arms 57 is thereby adjustable in accordance with the height of the panel 13 by means of the cylinders 55 and intervals between the respective arms 57 are adjustable in accordance with the mounting pitch of the lifting hooks 13A along the guide bars 56.

As shown in FIG. 1, the aforesaid support frame 42 is vertically movably provided between two supports formed at one side thereof in a direction perpendicularly intersecting the paper surface in FIG. 1 with a panel support base 59, which is vertically movable by means of a cylinder 60. Additionally, the support base 59 is provided thereon with a lifting hook clamp mechanism 61, which clamps the lifting hooks 13A of the panel 13, so that the panel 13 can be secured in an erected state until the arms 57 of the hook engaging mechanism 53 are engaged with these hooks 13A.

Figure 10:
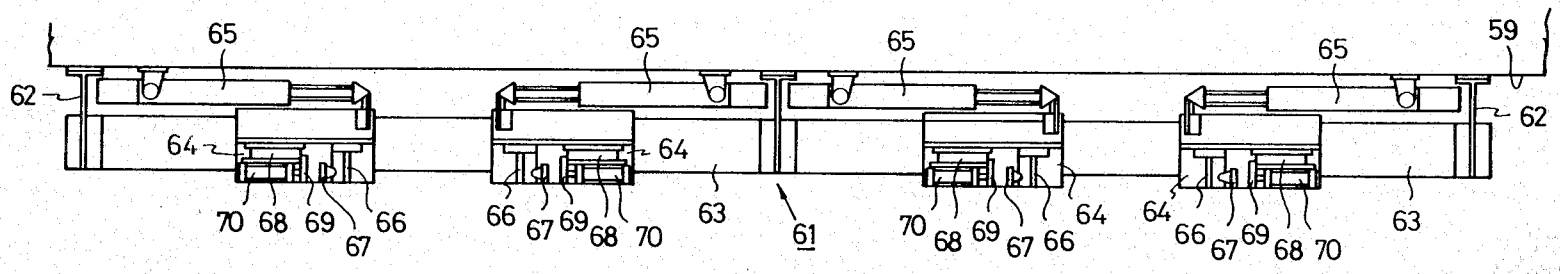
FIG. 10 is an enlarged front view showing the lifting hook clamp mechanism used in this embodiment.
Figure 11:
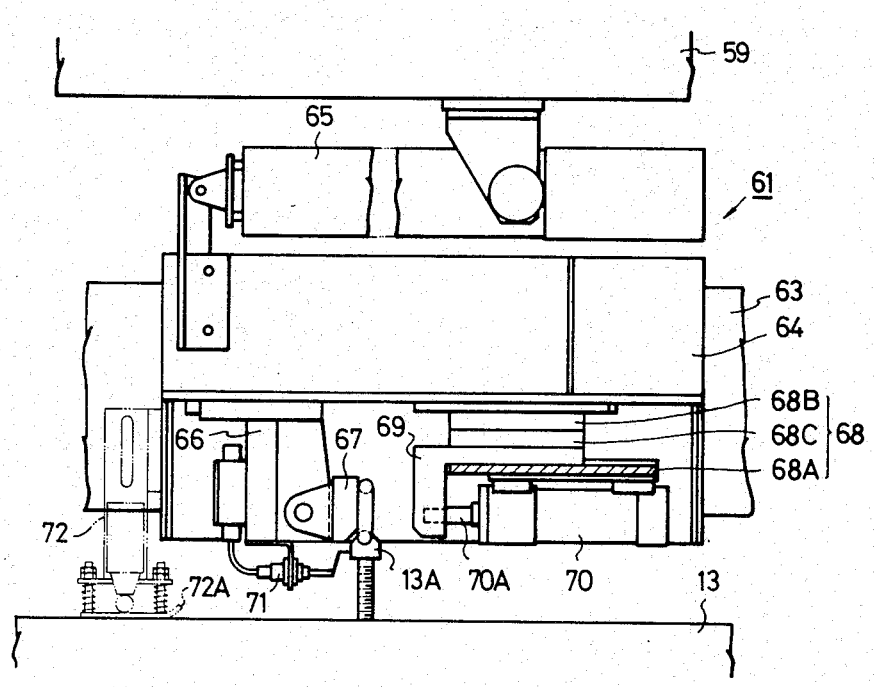
FIG. 11 is an enlarged view showing essential portions in FIG. 10.

As shown enlarged in FIGS. 10 and 11, the lifting hook clamp mechanism 61 comprises: guide members 63 suspended from the panel support base 59 through T-shape beams 62; slidable bases 64 provided in a number equal to the number of lifting hooks 13A of the panel 13, e.g. four, and slidably secured to the guide members 63; cylinders 65 secured to the panel support base 59 through trunnions for moving the respective slidable bases 64 to positions opposed to the respective lifting hooks 13A of the panel; stationary side clamp members 67 provided on the slidable bases 64 through brackets 66, respectively; movable side clamp members 69 being L-shaped in side plan opposed to the stationary side clamp members 67 and slidably supported between the lower sides 68A of the guide brackets 68 and ridges 68C provided on side walls 68B; clamping cylinders 70 fixed onto lower sides 68A of the guide brackets, the forward ends of piston rods 70A of which are connected to the movable side clamp members 69 for linearly moving the clamp members 69 to the stationary side clamp members 67; and touch sensors 71 fixed onto the brackets 66, the forward ends of which are disposed at portions adjacent the stationary side clamp members 67 for sensing the abutments of the stationary side clamp members 67 with the lifting hooks 13A to stop the slidable base driving cylinders 65 from operating and cause the clamping cylinders 70 to clamp the lifting hooks 13A between the clamp members 67 and 69. Additionally, out of these lifting hook clamp mechanisms 61, those arranged at suitable positions, e.g. at opposite ends are provided with roller plunger type limit switches 72, respectively, and projectable lower sides 72A of the limit switches 72 are adapted to abut against the upper ends of the panel 13 to stop the support base driving cylinders 60 from operating.

Description will hereunder be given to the action of this embodiment.

When the piston rod 8 of the cylinder 7 provided on the base frame 3 is in the retracted state and the erectable frame 4 is in the horizontal position, the mold bed 11 is moved onto the rails 9 of the erectable farme 4 by the wheels 12, and stopped in movement through the action of detecting means such as a limit switch, not shown. This stop in movement causes the cylinders 23 of the clamp mechanisms 16 to operate in directions to retract the piston rods 23A, whereby the projections 22A of the projected members 22 are engaged with the engageable recesses 15A of the engageable members 15, and the cylinders 28 of the mold bed urging mechanism 17 are operated in directions to push out the piston rods 28A, whereby the urging member 27 is abutted against the right side surface of the mold bed 11 in FIG. 1, so that the mold bed 11 can be positively supported at a chosen position by the urging of the urging member 27 of this urging mechanism 17 and the engagement of the clamp mechanism 16 with the engageable member 15. When this mold bed 11 is carried onto the erectable frame 4, from the mold 14 defining the periphery of the concrete panel 13 comprising a molding on the mold bed 11, the columnar members 14A in the front, rear (one in rear is not shown) and in the left in FIG. 1 are released from the peripheral surfaces of the panel 13 and brought into states of being laid down to the sides of the mold bed 11.

The cylinder 34 of the molding supporting mechanisms 18 are caused to operate to extend the piston rods 34A simultaneously or slightly behind the actions of the clamp mechanisms 16 and the urging mechanism 17, whereby the abutting pad 33 is abutted against the columnar member 14B at the right side of the mold 14.

Subsequently, the erecting cylinder 7 is caused to operate to extend the piston rod 8, whereby the erectable frame 4 holding the mold bed 11 is erected to a substantially vertical position, where the latter is stopped from movement by means of detecting means such as a limit switch, not shown. This stop in movement causes the cylinders 41 of the molding receiving mechanisms 35 to operate to extend the piston rods 41A, so that the abutting pads 40 can abut the columnar member 14B on the right side of the mold 14 (refer to a position indicated by two-dot chain lines in FIG. 7). This abutment causes the cylinders 34 of the molding supporting mechanisms 18 to operate in directions opposite to those as described above, i.e. the direction of extending the piston rods 34A, so that the concrete panel 13 can be supported on the side of the abutting pads 40 of the receiving mechanisms 35 through the columnar member 14B (Refer to FIG. 3).

After the panel 13 is supported by the receiving mechanisms 35 after the panel 13 is erected, or after the panel 13 is supported, firstly, the cylinder 60 of the panel support base 49 is operated, whereby the support base 49 is lowered to a position where the lifting hooks 13A enter substantially the centers of spaces formed between the respective clamp members 67, 69 to allow the clamp mechanism 61 to clamp the hooks 13A, and the lower sides 72A of the roller plunger type limit switches 72 are abutted against the top surface of panel 13 to operate the limit switches, whereby the cylinder 60 is stopped from operation.

Subsequently, the slidable base driving cylinders 65 of the lifting hook clamp mechanism 61 are operated in direction of retracting, whereby the slidable bases 64 are moved along the guide members 63. And, when the lifting hooks 13A of the panel 13 are abutted against the stationary side clamp members 67, the abutments are detected by the touch sensors 71, whereby, the cylinders 65 are stopped in operation and the clamping cylinders 70 are operated in protracting directions, so that the lifting hooks 13A can be clamped.

Thereafter, the cylinder 7 is operated in a direction opposite to that described above, i.e. the direction of retracting the piston rod 8, whereby the erectable frame 4 is laid down to the horizontal position. At this time, the mold bed 11 being firmly secured by the erectable frame 4 is released from the panel 13 and laid down together with the three columnar members 14A secured thereto. Upon completion of this, both the cylinders 23 of the clamp mechanisms 16 and the cylinders 28 of the mold bed urging mechanism 17 are operated in directions opposite to those described above, whereby the mold bed 11 is released from being secured. The shuttering bed 11 thus released from being secured is moved to the carry-out side by means of the wheels 12, and a new shuttering bed 11, i.e. another shuttering bed 11 having mounted thereon a concrete panel 13 is moved onto the erectable frame 4, whereby the mold bed 11 is secured in the same manner as described above.

On the other hand, the hook engaging mechanism 53 of the carrier 43, which has previously moved to a predetermined position through the action of the cylinders 55, are opposed to the hooks 13A of the panel 13 clamped by means of the hook clamp mechanism 61, whereby the arms 57 of this engaging mechanism 53 are engaged and fixed by an operator on the working table. Upon completion of the engagement of the arms 57, the clamping cylinders 70 of the hook clamp mechanism 61 and the slidable base driving cylinders 65 are operated in directions opposite to those described above to release the lifting hooks 13A from being clamped. Subsequently, the cylinder 60 is operated in a direction opposite to that described above for raising the panel support base 59, whereby the panel 13 is ready for being carried out by means of the carrier 43.

Furthermore, simultaneously with the operation of the hook engaging mechanism 53 or upon completion of the engagement, the support arm operating cylinders 51 are operated to upwardly move the support arms 52. When these support arms 52 are abutted against the columnar member 14B supporting the panel 13, the support arms 52 are stopped from upward movement by detecting means such as limit switches, not shown. This stop of the support arms 52 in upward movement causes the cylinders 41 of the molding receiving mechanisms 35 to move in a direction opposite to the one described above to lower the abutting pads 40, whereby the panel 13 is supported by the support arms 52 through the columnar member 14B. On the other hand, the cylinders 41 of the molding receiving mechanisms 35 are operated to reach the stroke ends in the retracting directions, where the latter are stopped and ready for receiving the succeeding panel 13.

The panel 13 thus supported on the support arms 52 and prevented by the arms 57 of the lifting hook engaging mechanism 53 from falling off and so forth is carried out to a predetermined position for the succeeding step of work due to the movement of the carrier 43, whereby the succeeding vacant carrier 43 not supporting a panel 13 is moved to a position corresponding to the erectable frame 4 due to the movement of the carrier 43 supporting the aforesaid panel 13, so as to be ready for supporting the succeeding panel 13.

Thus, the abovedescribed operation is repeated, so that the releasing and carry-out work can be automatically carried out.

In the abovedescribed embodiment, only the concrete panel 13 which is a molding is received by means of the receiving mechanisms 35 in the state wherein the erectable frame 4 is erected, and immediately after the receiving, the erectable frame 4 is laid down, so that the releasing work from the molding can be continuously carried out at a high efficiency. Furthermore, the mold bed 11 is positively supported by the mold bed securing mechanism constituted by the clamp mechanisms 16, the mold bed urging mechanism 17 and the engageable members 15, so that the operation can be carried out in safety without a fear of the panel falling down and the like. Further, the hydraulic pressure-operated cylinders are used as the driving sources for all of the components including the erectable frame 4, the clamp mechanisms 16, the shuttering bed urging mechanism 17, the molding receiving mechanisms 35, the support arms 52, the panel support base 59, the hook clamp mechanism 61 and so forth, so that the automatic operation combined with suitable detecting means can be effected by the suitable design of the hydraulic pressure circuits, thereby saving labor and decreasing the operating costs to a considerable extent. Additionally, the panel 13 thus released is immediately thereafter carried to a predetermined position for the succeeding step of work by means of the carrier 43, so that the flow of the process of producing the panel 13 as a whole can be made smooth, thus enabling to improve the operation efficiency from this view point too.

Furthermore, in working the present invention, the mold bed securing mechanism constituted by the clamp mechanisms 16 and so forth may be of a modified arrangement, and, in short, any arrangement may be adopted, which can positively support the mold bed 11. Additionally, the driving sources are not limited to cylinders, and any other means such as electric motors may be used. Further, the direction of carrying in shuttering bed 11 need not necessarily be horizontal as in the abovedescribed embodiment, and the direction may be inclined to some extent in association with the preceding step or work. Furthermore, the concrete panel being a molding is not limited to the concrete panel 13, but, may be any other type of molding. Further, the concrete panel 13 being a molding may be directly supported by the abutting pads 33, 40 and so forth, without using the columnar members 14. Furthermore, the molding receiving mechanisms 35 and the lifting hook clamp mechanism 61 need not necessary be provided. The panel 13 may be directly received by the support arms 52 of the carrier 43 in the state where the shuttering bed 11 is erected by means of the erectable frame 4. However, the provision of the receiving mechanisms 35 and so forth may offer such an advantage that the erectable frame 4 can be dropped down during the transfer of the panel 13 over onto the carrier 43, to thereby improve the operation efficiency. Further, the lifting hook engaging mechanism 53 need not necessarily be in the arrangement shown in the abovedescribed embodiment, but such an arrangement can be adopted to use the cylinders 65, 70 and so forth as in the lifting hook clamp mechanism 61.

As has been described hereinabove, the present invention can offer such an advantage as providing a release and carryout apparatus capable of releasing the mold and the like from the molding such as a concrete panel and carrying out the molding at a high efficiency.

What is claimed is:

1. An apparatus for releasing a molded article from a mold and transporting the molded article to another location, comprising:

a base;

a mold including a mold bed and a plurality of frame members disposed thereon and defining the perimeter of a mold cavity, said mold bed having a plurality of wheels mounted on the bottom thereof;

means for transporting said mold in a substantially horizontal position after forming a molded article in the mold cavity, the molded article having lifting hooks projecting from one edge thereof;

an erectable frame, horizontal pivot means at one end portion of said frame, said pivot means mounting said frame on said base for pivotal movement with respect to said base between a substantially horizontal position and an upright position, said mold transporting means comprising a pair of rails formed on the upper side of said erectable frame in alignment with said wheels whereby said mold can be moved along said rails until said mold bed is in position to be secured to said erectable frame, said mold transporting means being adapted to bring said mold onto said erectable frame in a substantially horizontal position;

means for moving said erectable frame between said horizontal and upright positions;

means for releasably securing said mold bed to said erectable frame so that said mold bed carrying a molded article thereon can be transported onto said erectable frame when said frame is in its horizontal position, then secured to said erectable frame, and then moved to an upright position with said erectable frame, said one edge of the molded article being the upper edge when the molded article is in the upright position so that said lifting hooks project upwardly;

a receiving mechanism adapted to receive and support the molded article in the upright position thereof when said mold bed is removed from the molded article and said erectable frame is moved from the upright position to the substantially horizontal position;

a clamp mechanism for clamping said lifting hooks to releasably secure the upper edge of the molded article when it is supported upright on said receiving mechanism;

a support frame provided above said clamp mechanism; and a carrier movably mounted on said support frame adapted to support and maintain the molded article in an upright position when the molded article is released from said receiving mechanism and said clamp mechanism, and to transport the molded article along said support frame.

2. An apparatus as claimed in claim 1, wherein said receiving mechanism comprises an upright cylinder mounted on said base, an upright bracket mounted on said base, a receiving member vertically movably mounted on said bracket, and a piston rod connected to said receiving member and said cylinder for effecting vertical movement of said receiving member into and out of position to support the molded article when it is in its upright position.

3. An apparatus as claimed in claim 1, wherein said pivot means comprises a horizontal shaft mounted on said base adjacent to said receiving mechanism, said one end portion of said erectable frame being rotatably mounted on said shaft.

4. An apparatus as claimed in claim 1, wherein said mold comprises said mold bed and four of said frame members, each of said frame members being a columnar member, said frame members defining therebetween a rectangular frame, one of said frame members being adapted to be received on said receiving mechanism when the molded article is moved to the upright position thereof with said erectable frame, said one frame member being interposed between said receiving mechanism and the molded article, the remainder of said frame members having been removed from the molded article when the molded article and said mold are disposed in said substantially horizontal position on said erectable frame.

5. An apparatus as claimed in claim 1, wherein said means for releasably securing said mold to said erectable frame comprises a pair of first and second mutually engageable members, said first engageable member being mounted on the bottom of said mold bed, said second engageable member being mounted on said erectable frame, means for bringing said engageable members into engagement by moving said second engageable member into engagement with said first engageable member, and a mechanism for urging said mold bed at a side portion thereof whereby said first engageable member is pressed against said second engageable member.

6. An apparatus as claimed in claim 1, wherein said clamp mechanism comprises an upright panel support base, a guide member secured to said panel support base, a plurality of slidable bases mounted for sliding movement along the length of said guide member, each of said slidable bases having a pair of clamp members mounted thereon, and means for moving said clamp members together and apart to engage and disengage said lifting hooks on the molded article.

7. An apparatus as claimed in claim 1 or claim 6, wherein said carrier comprises a plurality of wheels mounted at an upper portion of said carrier, which wheels allow said carrier to move along said support frame, a pair of substantially vertically extending supports, said supports extending downwardly from said upper portion of said carrier, a vertically movable frame mounted on said supports and spanning said supports in the direction of travel of said carrier, a plate secured to and spanning said vertically movable frame in the direction of travel of said carrier, said plate being elongated in the direction of travel of said carrier, a plurality of arms adjustably secured to said plate, which arms extend substantially perpendicularly to the plane of said plate, each of said arms having an end thereof having a slot therein, which slot is adapted to engage a respective lifting hook on the upper end of the molded article, whereby the molded article is secured to said carrier.

8. An apparatus as claimed in claim 7, wherein said carrier further comprises at least one vertically adjustable, horizontally extending support arm connected to a lower portion of said vertically movable frame, said support arms being adapted to be brought into abutment with a lower edge of the molded article for supporting the molded article as the molded article is transported by said carrier.

9. An apparatus as claimed in claim 3, wherein said means for erecting said erectable frame comprises a cylinder secured to said base frame, and a piston associated with said cylinder and connected to said erectable frame, whereby said erectable frame pivots on said shaft when said piston is extending from said cylinder.

* * * * *